US009574569B2

(12) United States Patent
Chang et al.

(10) Patent No.: US 9,574,569 B2
(45) Date of Patent: Feb. 21, 2017

(54) RECIRCULATION FAN AND WIND-GUIDING DEVICE THEREOF

(75) Inventors: Shun-Chen Chang, Taoyuan Hsien (TW); Wen-Bin Liu, Taoyuan Hsien (TW); Kun-Fu Chuang, Taoyuan Hsien (TW)

(73) Assignee: DELTA ELECTRONICS, INC., Taoyuan Hsien (TW)

( * ) Notice: Subject to any disclaimer, the term of this patent is extended or adjusted under 35 U.S.C. 154(b) by 862 days.

(21) Appl. No.: 13/479,976

(22) Filed: May 24, 2012

(65) Prior Publication Data

US 2013/0149115 A1 Jun. 13, 2013

(30) Foreign Application Priority Data

Dec. 9, 2011 (TW) ..... 100145577 A

(51) Int. Cl.

| | |
|---|---|
| ***F04D 25/08*** | (2006.01) |
| ***F04D 19/02*** | (2006.01) |
| ***F04D 19/00*** | (2006.01) |
| ***F04D 25/12*** | (2006.01) |
| ***F04D 29/54*** | (2006.01) |
| *F04D 29/32* | (2006.01) |

(52) U.S. Cl.

CPC ..... *F04D 25/082* (2013.01); *F04D 19/007* (2013.01); *F04D 19/026* (2013.01); *F04D 25/12* (2013.01); *F04D 29/541* (2013.01); *F04D 29/329* (2013.01)

(58) Field of Classification Search

CPC .... F04D 13/024; F04D 13/027; F04D 19/007; F04D 19/026; F04D 25/026; F04D 29/048; F04D 29/058; F04D 29/329;F04D 29/54; F04D 25/082; F04D 25/12; F04D 29/541; F05B 2240/51; F05B 2240/511; F05B 2240/515; F05B 2240/302; F05B 2240/404; F05B 2240/4041; F05B 2240/903

USPC ..... 416/120, 124, 125, 198 R, 247 R; 415/198.1, 199.4, 208.1, 211.2

See application file for complete search history.

(56) References Cited

U.S. PATENT DOCUMENTS

| | | | | |
|---|---|---|---|---|
| 3,173,478 | A * | 3/1965 | Maycen | 165/121 |
| 5,131,810 | A * | 7/1992 | Wang | 415/208.1 |
| 6,648,751 | B1 * | 11/2003 | Pong | 454/297 |
| 2010/0303617 | A1 * | 12/2010 | Chen | 415/208.2 |
| 2011/0223042 | A1 * | 9/2011 | Chang et al. | 417/313 |

* cited by examiner

*Primary Examiner* — Dwayne J White
*Assistant Examiner* — Adam W Brown
(74) *Attorney, Agent, or Firm* — Kirton McConkie; Evan R. Witt

(57) ABSTRACT

A recirculation fan includes a casing, a covering member, a wind-guiding device, a passive impeller, and an active impeller. The covering member is coupled with the casing to define an accommodation space. The wind-guiding device is disposed on the covering member, and includes a wind-guiding cover and a magnetoresistive structure. The magnetoresistive structure is disposed on the covering member and the wind-guiding cover. The passive impeller is disposed within the accommodation space. The active impeller is disposed within the accommodation space and located beside the passive impeller for generating a wind to drive rotation of the passive impeller and the wind-guiding cover. In response to a magnetic torque resulted from a magnetic vortex of the magnetoresistive structure, a rotating speed of the wind-guiding cover is slowed down.

12 Claims, 8 Drawing Sheets

RECIRCULATION FAN AND WIND-GUIDING DEVICE THEREOF

FIELD OF THE INVENTION

The present invention relates to a recirculation fan, and more particularly to a recirculation fan driven with a magnetoresistive structure for optimizing the wind-guiding efficacy. The present invention also provides a wind-guiding device of the recirculation fan.

BACKGROUND OF THE INVENTION

In recent years, with increasing environmental consciousness, more and more products are designed in views of energy conservation and carbon reduction policy. Consequently, government organizations, enterprises, schools or families pay much attention to the reduction of the frequency and time period of using the air conditioners. For maintaining air circulation and increasing space utilization, a variety of new fans and recirculation fans are introduced into the market.

For most fans, a motor is employed to drive rotation of the fan blades and the wind-guiding device. The rotation of the fan blades may produce airflow. The rotation of the wind-guiding device may blow the airflow to different regions. Consequently, the convection within the indoor construction site will be enhanced and the indoor temperature can be controlled.

For increasing the space utilization, the mainstream of the indoor recirculation fan is for example an embedded-type recirculation fan. However, due to the spatial and position limitation, the performance of such recirculation fan is usually unsatisfied. In addition, if the amount of the airflow required for indoor convection is increased, the recirculation fan should have a longer and larger fan blade. Correspondingly, a large-power and large-size motor is used to provide sufficient torque to rotate the recirculation fan. For complying with the large-size motor, the volume of the fan should be largely increased. Under this circumstance, a lot of space is occupied. Moreover, since the wind-guiding device of the current recirculation fan is synchronously driven by the motor, the rotating speed is possibly too fast and the airflow is centralized. In other words, since the airflow fails to be effectively spread to various regions, the air-circulating efficiency is deteriorated. In addition, since the overall power consumption is largely increased, it is difficult to achieve the energy conservation and carbon reduction purpose. In other words, the process of deploying the conventional recirculation fan is complicated and the layout cost is increased.

SUMMARY OF THE INVENTION

As previously described, if the amount of the airflow required for indoor convection is increased, the conventional fan should have a longer and larger fan blade and a large-power and large-size motor is necessary. Under this circumstance, the overall volume and the overall power consumption are largely increased, the rotating speed is possibly too fast and the airflow is centralized, the airflow fails to be effectively spread to various regions, the air-circulating efficiency is deteriorated, the overall power consumption is largely increased, it is difficult to achieve the energy conservation and carbon reduction purpose. One object of the present invention is to provide a recirculation fan and a wind-guiding device of the recirculation fan for eliminating the drawbacks encountered from the prior art.

It is another object of the present invention to provide a recirculation fan and a wind-guiding device of the recirculation fan, in which the wind generated by the active impeller can drive rotation of the passive impeller, so that a small-size impeller and a small-size motor may be employed. Consequently, the overall volume and power consumption of the recirculation fan are reduced, the space layout is simplified, and the cost is reduced. Moreover, by using the magnetoresistive structure to adjust the rotating speed of the wind-guiding cover of the wind-guiding device, the wind-guiding efficacy is optimized. As a consequence, the air-circulating efficiency is enhanced, the power-saving efficacy is enhanced, the space utilization is enhanced, and the cost is reduced.

In accordance with an aspect of the present invention, there is provided a recirculation fan. The recirculation fan includes a casing, a covering member, a wind-guiding device, a passive impeller, and an active impeller. The covering member is coupled with the casing to define an accommodation space. The wind-guiding device is disposed on the covering member, and includes a wind-guiding cover and a magnetoresistive structure. The magnetoresistive structure is disposed on the covering member and the wind-guiding cover. The passive impeller is disposed within the accommodation space. The active impeller is disposed within the accommodation space and located beside the passive impeller for generating a wind to drive rotation of the passive impeller and the wind-guiding cover. In response to a magnetic torque resulted from a magnetic vortex of the magnetoresistive structure, a rotating speed of the wind-guiding cover is slowed down.

In accordance with another aspect of the present invention, there is provided a wind-guiding device for a recirculation fan. The recirculation fan includes a covering member and an active impeller. The wind-guiding device is disposed on the covering member. The wind-guiding device includes a wind-guiding cover and a magnetoresistive structure. A wind generated by active impeller drives rotation of the wind-guiding cover. The magnetoresistive structure is disposed on the covering member and the wind-guiding cover. In response to a magnetic torque resulted from a magnetic vortex of the magnetoresistive structure, a rotating speed of the wind-guiding cover is slowed down.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
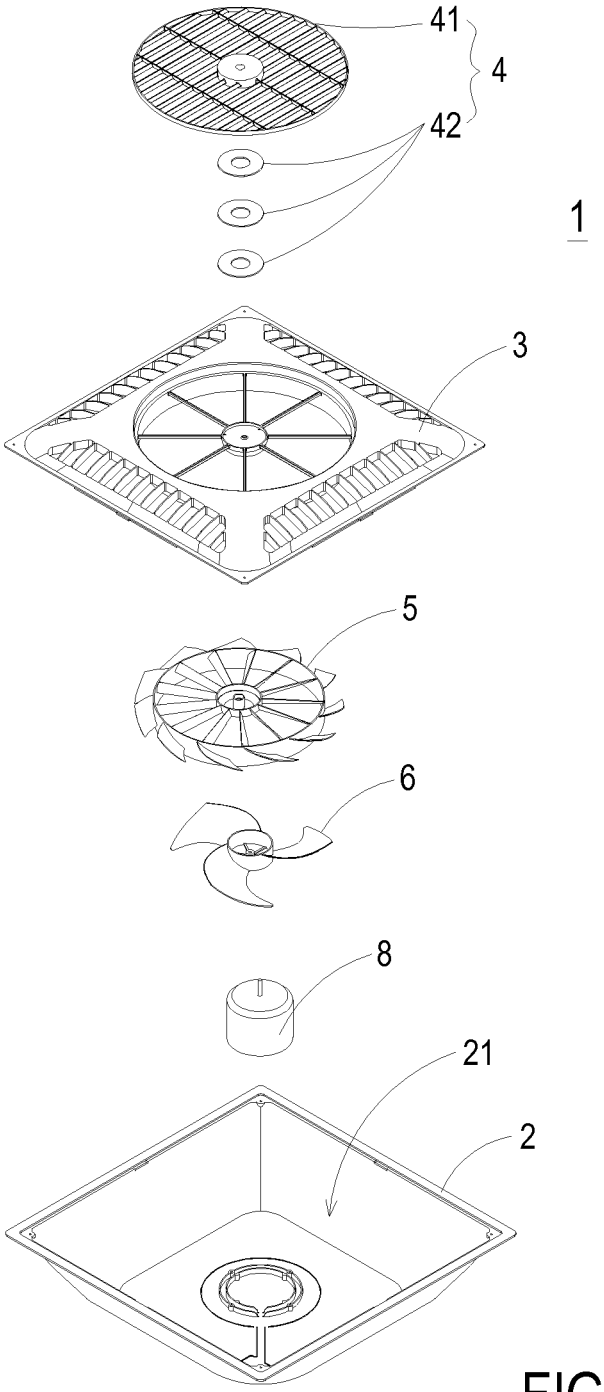
FIG. 1 is a schematic exploded view illustrating a recirculation fan according to an embodiment of the present invention.

FIG. 1 is a schematic exploded view illustrating a recirculation fan according to an embodiment of the present invention. The recirculation fan 1 is used to increase the convection and control the environmental temperature. As shown in FIG. 1, the recirculation fan 1 comprises a casing 2, a covering member 3, a wind-guiding device 4, a passive impeller 5, and an active impeller 6. After the covering member 3 is combined with the casing 2, an accommodation space 21 is defined to accommodate some components of the recirculation fan 1 and provide a space for operating the passive impeller 5 and the active impeller 6. The wind-guiding device 4 is disposed on the covering member 3. In addition, the wind-guiding device 4 comprises a wind-guiding cover 41 and a magnetoresistive structure 42. The magnetoresistive structure 42 is disposed on both of the covering member 3 and the wind-guiding cover 41. The passive impeller 5 is disposed within the accommodation space 21. The active impeller 6 is located beside the passive impeller 5, and disposed within the accommodation space 21. During operation of the active impeller 6, the passive impeller 5 and the wind-guiding cover 41 are driven to be rotated.

In some embodiments, the magnetoresistive structure 42 comprises permanent magnets or magnetic conductors (e.g. iron, cobalt and nickel magnetic conductors). For example, the magnetoresistive structure 42 includes a plurality of permanent magnets, which are disposed on both of the covering member 3 and the wind-guiding cover 41. Alternatively, the magnetoresistive structure 42 comprises a permanent magnet and a magnetic conductor, wherein the permanent magnet is disposed on one of the covering member 3 and the wind-guiding cover 41, and the magnetic conductor is formed on the other one of the covering member 3 and the wind-guiding cover 41. Due to magnetic change and magnetic induction, the magnetoresistive structure 42 generates a magnetic vortex. In response to the magnetic vortex, a magnetic torque is generated, so that the rotating speed of the wind-guiding cover 41 is slowed down or reduced. By using the magnetoresistive structure 42 to adjust the rotating speed of the wind-guiding cover 41 of the wind-guiding device 4, the wind-guiding efficacy is optimized. As a consequence, the air-circulating efficiency is enhanced, the power-saving efficacy is enhanced, the space utilization is enhanced, and the cost is reduced.

Figure 2A:
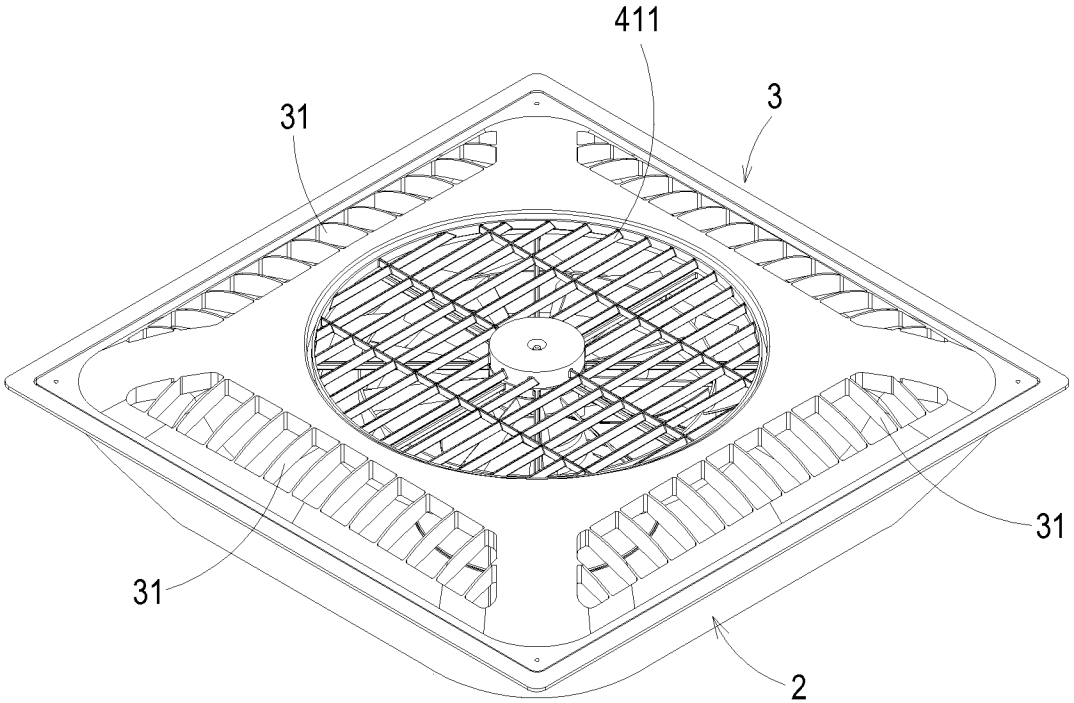
FIG. 2A is a schematic top view illustrating the assembled recirculation fan of FIG. 1.
Figure 2B:
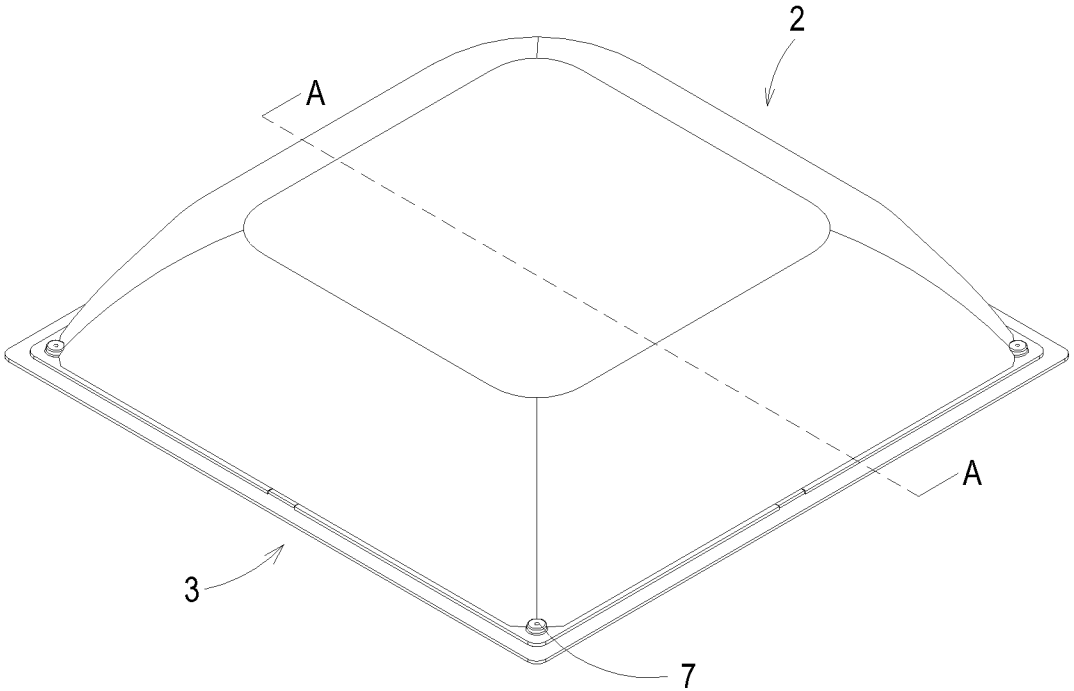
FIG. 2B is a schematic bottom view illustrating the assembled recirculation fan of FIG. 1.

FIG. 2A is a schematic top view illustrating the assembled recirculation fan of FIG. 1. FIG. 2B is a schematic bottom view illustrating the assembled recirculation fan of FIG. 1. Please refer to FIGS. 2A and 2B. After the covering member 3 is combined with the casing 2, an accommodation space 21 is defined between the covering member 3 and the casing 2. The passive impeller 5 and the active impeller 6 are disposed within the accommodation space 21. Consequently, the active impeller 6 is operated within the accommodation space 21, and the wind generated by the active impeller 6 may drive rotation of the passive impeller 5 within the accommodation space 21. In other words, the passive impeller 5 and the active impeller 6 are disposed and rotated within the region between the covering member 3 and the casing 2. Since the wind generated by the active impeller 6 drives rotation of the passive impeller 5, a small-size impeller and a small-size motor are feasible. Consequently, the volume and power consumption of the recirculation fan are reduced, the air-circulating efficiency is enhanced, the noise is reduced, and the recirculation fan can comply with the safety regulations.

In some embodiments, the covering member 3 further comprises a first airflow-guiding structure 31, and the wind-guiding cover 41 further comprises a second airflow-guiding structure 411. The first airflow-guiding structure 31 and the second airflow-guiding structure 411 are for example annular structures, sheet structures, meshed structures, hollow structures or rectangular structures. Due to the first airflow-guiding structure 31 and the second airflow-guiding structure 411, the regions to inhale or exhale the airflow will be increased. Alternatively, the first airflow-guiding structure 31 and the second airflow-guiding structure 411 can withstand the wind from the active impeller 6, thereby driving rotation of the passive impeller 5 or the wind-guiding cover 41. Moreover, according to the principles of fluid mechanics, the amount of airflow required for operating the active impeller 6 may be increased or a portion of the airflow generated by the passive impeller 5 and the active impeller 6 may be recycled and re-circulated. Consequently, the overall efficiency of air convection circulation is enhanced, the overall volume and power consumption of the recirculation fan are reduced, the power-saving efficacy is enhanced, the space utilization is enhanced, and the cost is reduced.

In this embodiment, the casing 2 and the covering member 3 of the recirculation fan 1 are combined together by an adhering means, a screwing means or an engaging means. As shown in FIG. 2B, the recirculation fan 1 further comprises at least one fastening element 7 for connecting the casing 2 with the covering member 3 in order to increase the structural strength and use safety. In addition, the recirculation fan 1 of the present invention is suitably installed in an indoor construction site. For facilitating the user to detach the recirculation fan 1, the fastening element 7 is a screw/nut assembly. After the screw is penetrated through the covering member 3 and the casing 2, the screw is coupled with the nut.

Figure 3A:
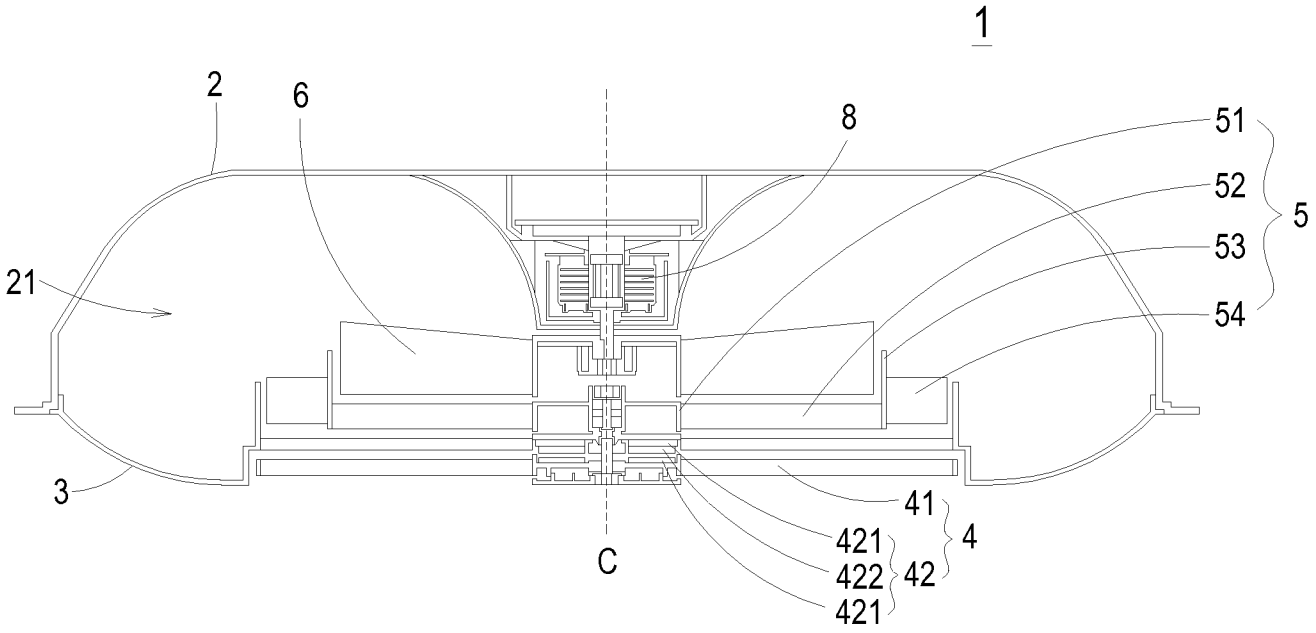
FIG. 3A is a schematic cross-sectional view illustrating the recirculation fan of FIG. 2B and taken along the line A-A.

FIG. 3A is a schematic cross-sectional view illustrating the recirculation fan of FIG. 2B and taken along the line A-A. Please refer to FIGS. 1 and 3A. The wind-guiding device 4 of the present invention is applied to a recirculation fan 1 including a casing 2, a covering member 3, a passive impeller 5 and an active impeller 6. The wind-guiding device 4 comprises a wind-guiding cover 41 and a magnetoresistive structure 42. The magnetoresistive structure 42 is disposed on both of the covering member 3 and the wind-guiding cover 41. After the covering member 3 is combined with the casing 2, an accommodation space 21 is defined to accommodate the passive impeller 5 and the active impeller 6. The active impeller 6 is located beside the passive impeller 5. The active impeller 6 is connected with the motor 8. The active impeller 6 is driven by the motor 8, so that the active impeller 6 is rotated relative to a center axle line C. As the active impeller 6 is rotated, the wind generated by the active impeller 6 may drive rotation of the wind-guiding cover 41 and the passive impeller 5. In some embodiments, the wind-guiding cover 41 and the passive impeller 5 are also rotated relative to the center axle line C. That is, the wind-guiding cover 41, the passive impeller 5 and the active impeller 6 are substantially rotated relative to the center axle line C. All of the wind-guiding cover 41, the passive impeller 5 and the active impeller 6 may be rotated in a clockwise direction or an anti-clockwise direction. Alternatively, the wind-guiding cover 41, the passive impeller 5 and the active impeller 6 may be rotated in opposite directions.

In some embodiments, the magnetoresistive structure 42 comprises at least one first magnetic member 421 and at least one second magnetic member 422. The first magnetic member 421 is disposed on both of the covering member 3 and the wind-guiding cover 41. The second magnetic member 422 is disposed on one of the covering member 3 and the wind-guiding cover 41. The first magnetic member 421 and the second magnetic member 422 are permanent magnets or magnetic conductors (e.g. iron, cobalt and nickel magnetic conductors). Due to magnetic change and magnetic induction, the magnetoresistive structure 42 generates a magnetic vortex. In response to the magnetic vortex, a magnetic torque is generated, so that the rotating speed of the wind-guiding cover 41 is slowed down or reduced. In an embodiment, the first magnetic member 421 is a magnetic conductor, and the second magnetic member 422 is a permanent magnet. Alternatively, the first magnetic member 421 is a permanent magnet, and the second magnetic member 422 is a magnetic conductor. Preferably, the first magnetic member 421 is a magnetic conductor disposed on both of the covering member 3 and the wind-guiding cover 41, and the second magnetic member 422 is a permanent magnet disposed on the covering member 3. Consequently, the magnetoresistive structure 42 can result in a good damping effect. By using the magnetoresistive structure 42 to adjust the rotating speed of the wind-guiding cover 41 of the wind-guiding device 4, the wind-guiding efficacy is optimized. As a consequence, the air-circulating efficiency is enhanced, the power-saving efficacy is enhanced, the space utilization is enhanced, and the cost is reduced.

Figure 3B:
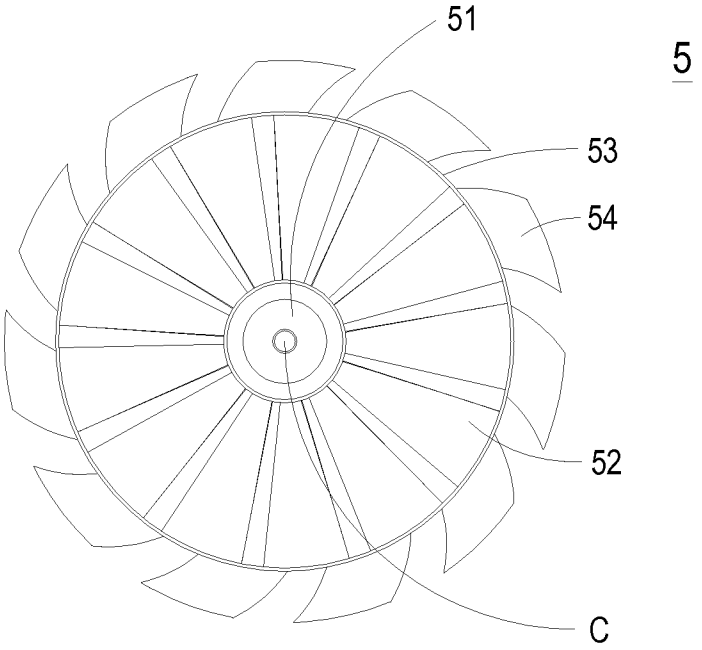
FIG. 3B is a schematic top view illustrating an exemplary passive impeller of the recirculation fan of the present invention.

FIG. 3B is a schematic top view illustrating an exemplary passive impeller of the recirculation fan of the present invention. Please refer to FIGS. 3A and 3B. In this embodiment, the passive impeller 5 of the recirculation fan 1 comprises a holder 51, a plurality of first blades 52, a ring-shaped structure 53, and a plurality of second blades 54. The first ends of these first blades 52 are disposed on an outer periphery of the holder 51. The second ends of these first blades 52 are connected with the ring-shaped structure 53. That is, the holder 51 is surrounded by the ring-shaped structure 53. The second blades 54 are discretely arranged on and connected with an outer periphery of the ring-shaped structure 53 at regular intervals. In such way, when the active impeller 6 is operated to generate the wind force, the first blades 52 of the passive impeller 5 are pushed by the wind force, so that the first blades 52 are rotated relative to the center axle line C. Since the holder 51 and the ring-shaped structure 53 are connected with the first blades 52 and the second blades 54 are connected with the ring-shaped structure 53, the holder 51 and the ring-shaped structure 53 and the second blades 54 are synchronously rotated with the first blades 52. As a consequence, the whole passive impeller 5 is rotated relative to the center axle line C. In some embodiments, the active impeller 6 is at least partially accommodated in a space defined by the ring-shaped structure 53 of the passive impeller 5, so that the efficacy of pushing the first blades 52 of the passive impeller 5 by the wind force resulted from the active impeller 6 will be increased.

Figure 3C:
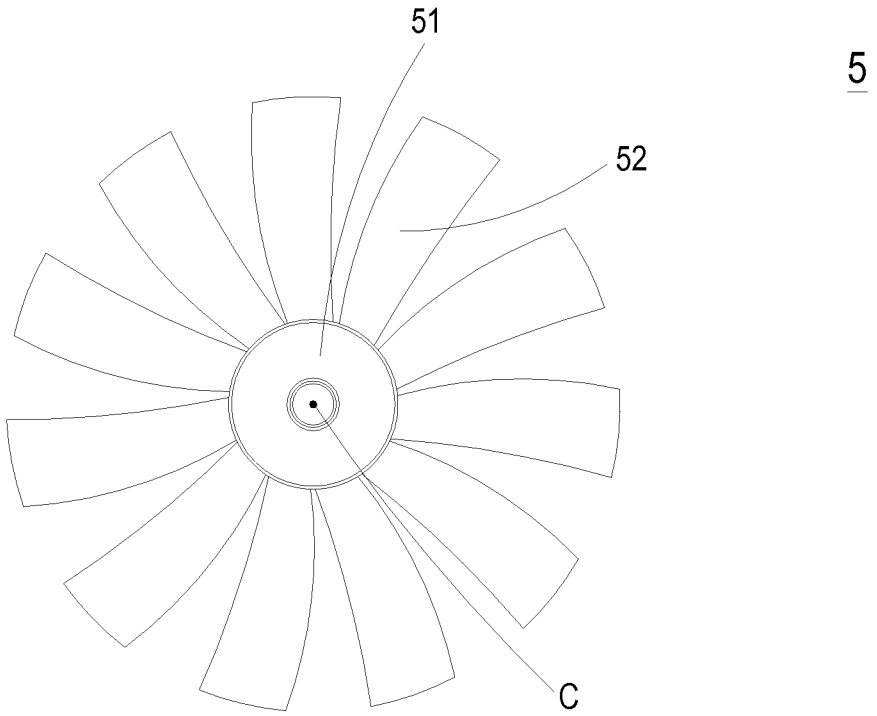
FIG. 3C is a schematic top view illustrating another exemplary passive impeller of the recirculation fan of the present invention.

FIG. 3C is a schematic top view illustrating another exemplary passive impeller of the recirculation fan of the present invention. Please refer to FIGS. 3A and 3C. In this embodiment, the passive impeller 5 of the recirculation fan 1 comprises a holder 51 and a plurality of first blades 52. These first blades 52 are disposed on an outer periphery of the holder 51. Moreover, the first blades 52 are discretely arranged on and connected with the outer periphery of the holder 51 at regular intervals. As the active impeller 6 is operated to generate the wind force, the first blades 52 of the passive impeller 5 are pushed by the wind force, so that the first blades 52 are rotated relative to the center axle line C. Since the holder 51 is connected with the first blades 52, the holder 51 is synchronously rotated with the first blades 52. As a consequence, the whole passive impeller 5 is rotated relative to the center axle line C.

Figure 3D:
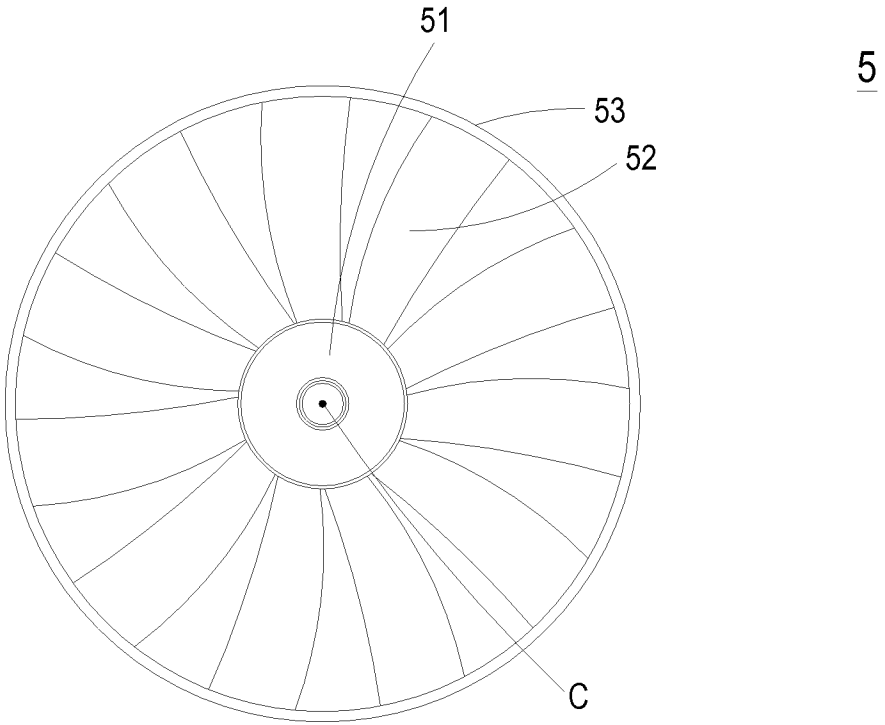
FIG. 3D is a schematic top view illustrating another exemplary passive impeller of the recirculation fan of the present invention.

FIG. 3D is a schematic top view illustrating another exemplary passive impeller of the recirculation fan of the present invention. Please refer to FIGS. 3A and 3D. In this embodiment, the passive impeller 5 of the recirculation fan 1 comprises a holder 51, a plurality of first blades 52, and a ring-shaped structure 53. The first ends of these first blades 52 are disposed on an outer periphery of the holder 51. The second ends of these first blades 52 are connected with the ring-shaped structure 53. That is, the holder 51 is surrounded by the ring-shaped structure 53. Moreover, the first blades 52 are discretely arranged on and connected with the outer periphery of the holder 51 at regular intervals. In such way, when the active impeller 6 is operated to generate the wind force, the first blades 52 of the passive impeller 5 are pushed by the wind force, so that the first blades 52 are rotated relative to the center axle line C. Since the holder 51 and the ring-shaped structure 53 are connected with the first blades 52, the holder 51 and the ring-shaped structure 53 are synchronously rotated with the first blades 52. As a consequence, the whole passive impeller 5 is rotated relative to the center axle line C.

Figure 3E:
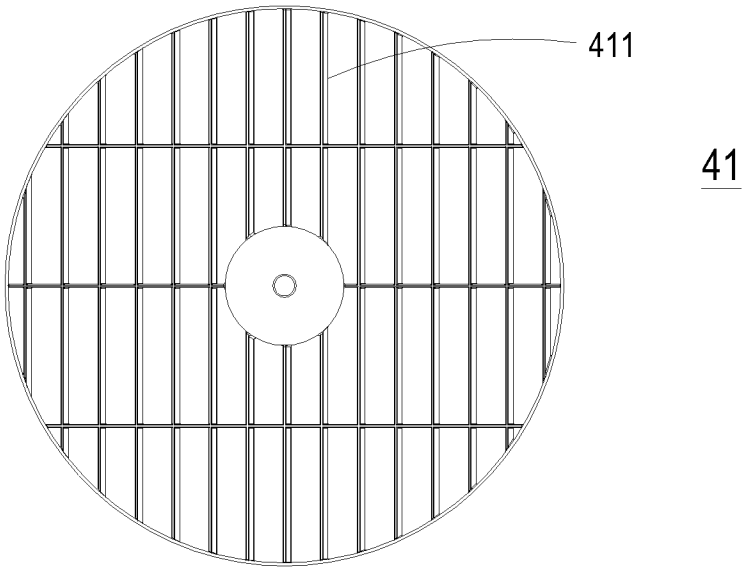
FIG. 3E is a schematic top view illustrating an exemplary wind-guiding cover of the recirculation fan of the present invention.

FIG. 3E is a schematic top view illustrating an exemplary wind-guiding cover of the recirculation fan of the present invention. Please refer to FIGS. 3A and 3E. In this embodiment, the second airflow-guiding structure 411 of the wind-guiding cover 41 of the wind-guiding device 4 comprises a plurality of blades. These blades have skew angles along the same direction, so that the outlet airflow can be distributed to a larger area. Under this circumstance, the air-circulating efficacy is enhanced. Moreover, since the wind-guiding cover 41 is rotated with the active impeller 6, the skew angle of the outlet airflow is also rotated and the outlet airflow can be flowed to a larger area. Moreover, in response to the magnetic torque resulted from the magnetic vortex generated by the magnetoresistive structure 42, the rotating speed of the wind-guiding cover 41 is slowed down or reduced. Consequently, the rotating speed is not too fast, and the airflow is not too centralized. Under this circumstance, the circulating efficacy is enhanced.

From the above description, the present invention provides a recirculation fan and a wind-guiding device of the recirculation fan. Since the wind generated by the active impeller can drive rotation of the passive impeller, a small-size impeller and a small-size motor may be employed.

Consequently, the overall volume and power consumption of the recirculation fan are reduced, the space layout is simplified, and the cost is reduced. Moreover, by using the magnetoresistive structure to adjust the rotating speed of the wind-guiding cover of the wind-guiding device, the wind-guiding efficacy is optimized. As a consequence, the air-circulating efficiency is enhanced, the power-saving efficacy is enhanced, the space utilization is enhanced, and the cost is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A recirculation fan, comprising:

a casing;

a covering member coupled with said casing to define an accommodation space;

a wind-guiding device disposed on said covering member, and comprising a wind-guiding cover and a magnetoresistive structure, wherein said magnetoresistive structure is disposed on said covering member and said wind-guiding cover, said magnetoresistive structure comprises at least one first magnetic member and at least one second magnetic member, and said first magnetic member and said second magnetic member are disposed between said wind-guiding cover and said covering member, and wherein one of said first magnetic member and said second magnetic member is a permanent magnet, and the other one of said first magnetic member and said second magnetic member is a magnetic conductor;

a passive impeller disposed within said accommodation space; and an active impeller disposed within said accommodation space and located beside said passive impeller for generating a wind to drive rotation of said passive impeller and said wind-guiding cover, wherein said covering member is disposed between said wind-guiding cover and said active impeller, and wherein in response to a magnetic torque resulted from a magnetic vortex of said magnetoresistive structure, a rotating speed of said wind-guiding cover is slowed down.

2. The recirculation fan according to claim 1, wherein said covering member further comprises a first airflow-guiding structure and a second airflow-guiding structure for increasing airflow-inhaling and airflow-exhaling regions.

3. The recirculation fan according to claim 2, wherein said airflow-guiding structure and said second airflow-guiding structure are annular structures, sheet structures, meshed structures, hollow structures or rectangular structures.

4. The recirculation fan according to claim 2, wherein said second airflow-guiding structure includes a plurality of blades having skew angles along the same direction.

5. The recirculation fan according to claim 1, wherein said recirculation fan further comprises at least one fastening element, wherein said fastening element is penetrated through said casing and said covering member, so that said casing and said covering member are combined together.

6. The recirculation fan according to claim 1, wherein said wind-guiding cover, said passive impeller and said active impeller are rotated relative to a center axle line.

7. The recirculation fan according to claim 1, wherein said passive impeller comprises a holder and a plurality of first blades, wherein first ends of said first blades are disposed on an outer periphery of said holder.

8. The recirculation fan according to claim 7, wherein said passive impeller further comprises a ring-shaped structure, wherein second ends of said first blades are connected with said ring-shaped structure, and said holder is surrounded by said ring-shaped structure.

9. The recirculation fan according to claim 8, wherein said passive impeller further comprises a plurality of second blades, wherein said second blades are connected to an outer periphery of said ring-shaped structure.

10. The recirculation fan according to claim 9, wherein said second blades of said passive impeller are discretely arranged on said outer periphery of said ring-shaped structure at regular intervals.

11. The recirculation fan according to claim 8, wherein said active impeller is at least partially accommodated in a space defined by said ring-shaped structure of said passive impeller.

12. A wind-guiding device for a recirculation fan, said recirculation fan comprising a covering member and an active impeller, said wind-guiding device being disposed on said covering member, said wind-guiding device comprising:

a wind-guiding cover, wherein a wind generated by said active impeller drives rotation of said wind-guiding cover, and wherein said covering member is disposed between said wind-guiding cover and said active impeller; and a magnetoresistive structure disposed on said covering member and said wind-guiding cover, wherein said magnetoresistive structure comprises at least one first magnetic member and at least one second magnetic member, one of said first magnetic member and said second magnetic member is a permanent magnet, the other one of said first magnetic member and said second magnetic member is a magnetic conductor, and said first magnetic member and said second magnetic member are disposed between said wind-guiding cover and said covering member, and wherein in response to a magnetic torque resulted from a magnetic vortex of said magnetoresistive structure, a rotating speed of said wind-guiding cover is slowed down.

* * * * *